US006076673A

United States Patent [19]

Fensham

[11] Patent Number: 6,076,673

[45] Date of Patent: Jun. 20, 2000

[54] BURST-PROOF PACK

[75] Inventor: Noel Cedric Fensham, Johannesburg, South Africa

[73] Assignee: Surgi International (Proprietary) Limited, Craighall, South Africa

[21] Appl. No.: 09/180,273

[22] PCT Filed: Mar. 6, 1998

[86] PCT No.: PCT/GB98/00668

§ 371 Date: Jan. 13, 1999

§ 102(e) Date: Jan. 13, 1999

[87] PCT Pub. No.: WO98/38954

PCT Pub. Date: Sep. 11, 1998

[30] Foreign Application Priority Data

Mar. 6, 1997 [ZA] South Africa ..... 97/1938
Oct. 6, 1997 [ZA] South Africa ..... 97/8924

[51] Int. Cl.[7] ..... A61F 13/00; B65D 77/20

[52] U.S. Cl. ..... 206/440; 206/210

[58] Field of Search ..... 206/438, 440, 206/441, 363, 205, 210, 461, 469, 564, 209, 484; 220/359.1, 359.2; 383/210, 211

[56] References Cited

U.S. PATENT DOCUMENTS

| | | | |
|---|---|---|---|
| 3,008,837 | 11/1961 | Kaplan | 206/484 |
| 3,083,821 | 4/1963 | Woodson | 206/484 |
| 3,685,720 | 8/1972 | Brady | 206/484 |
| 4,220,244 | 9/1980 | Elmore | 206/210 |
| 4,844,251 | 7/1989 | Gueret | 206/440 |
| 4,989,733 | 2/1991 | Patry | 206/440 |
| 5,117,981 | 6/1992 | Crawford et al. | 206/438 |

FOREIGN PATENT DOCUMENTS

| | | |
|---|---|---|
| 420519 | 4/1991 | European Pat. Off. . |
| 461640 | 12/1991 | European Pat. Off. . |
| 2575997 | 7/1986 | France . |

*Primary Examiner*—Paul T. Sewell
*Assistant Examiner*—Luan K. Bui
*Attorney, Agent, or Firm*—Oblon, Spivak, McClelland, Maier & Neustadt, P.C.

[57] ABSTRACT

A burst-proof pack which includes a blister tray having at least one recess defined therein which houses a sanitizing fluid and at least one swab. The recess is surrounded by a land, and a peelable web is sealed to the land via a sealing arrangement so as to provide a sealed compartment. The sealing arrangement includes an inner peripheral sealing band and an outer peripheral sealing band defining therebetween an intermediate pressure dissipation channel for preserving the overall integrity of the sealing arrangement in the event of one of the sealing bands being broached. The invention extends to a two-part pack including separate wet and dry sealed compartments for liquid and dry goods associated with surgical procedure.

18 Claims, 2 Drawing Sheets

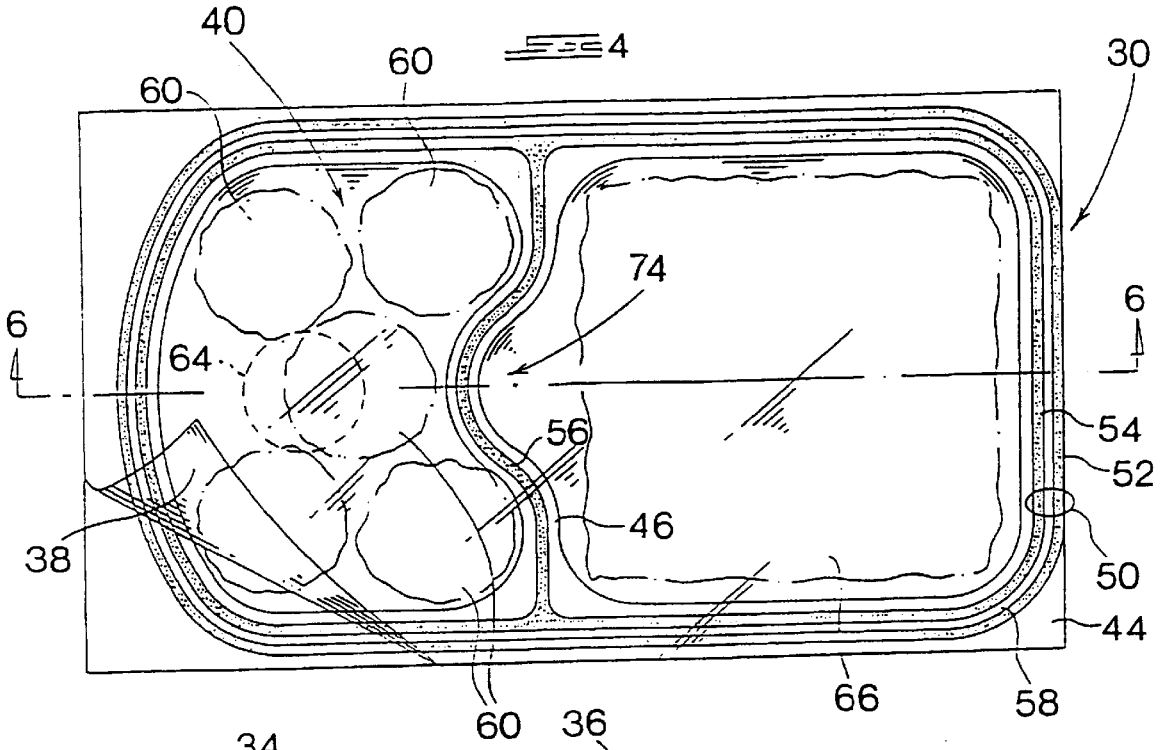
4
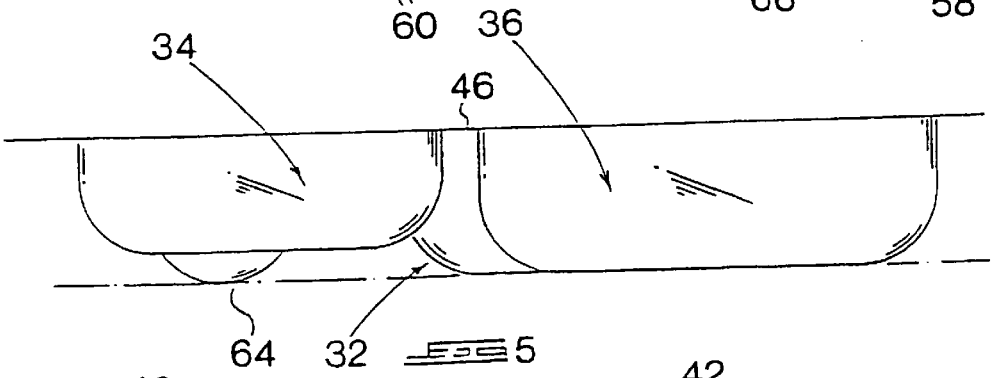
5
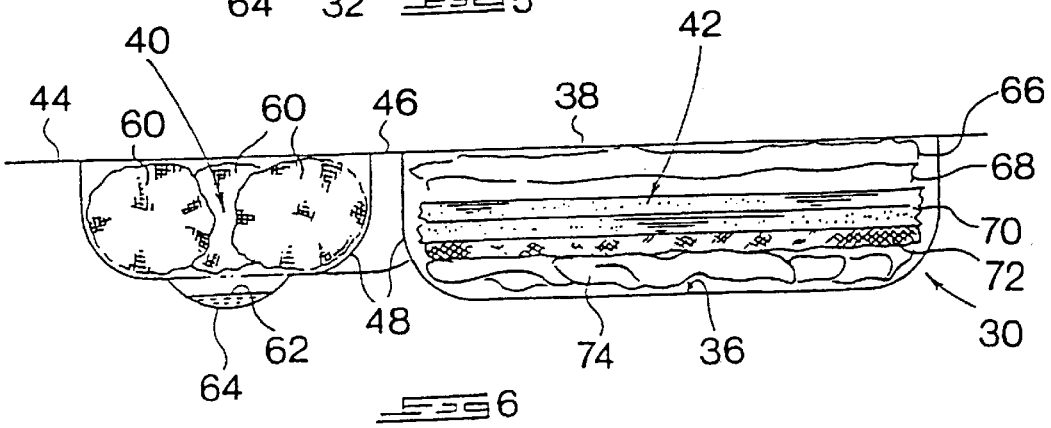
6

BURST-PROOF PACK

BACKGROUND TO THE INVENTION

This invention relates to a burst-proof pack.

The safe and cost effective management of wounds in hospitals and clinics is currently a priority. To this end, sterile blister packs containing dry dressings, swabs, bandages, needles, sutures and the like in a blister tray are typically used in operative and post-operative procedures. More often than not, there is considerable wastage due to the fact that not all of the contents of the sterile blister trays are utilized. Further, the blister trays themselves are relatively bulky, and contain a relatively high proportion of unused space.

Dry swabs are typically housed in a separate sterile pack. In a hospital environment several steps are required before such swabs can be used. A concentrated self-sterilizing or disinfecting solution is decanted and diluted, after which it is dispensed into a sterile pour bottle. The diluted solution is then dispensed into a separate steritized intermediate container. The sterile pack containing the dry swabs is opened and the dry swabs are similarly dispensed into the intermediate container, after which they can be used in a particular procedure.

The steps described above are relatively time consuming, carry associated risks of infection, and utilize at least three, if not four separate containers which need to be sterilized. Further, both swabs and disinfectant are usually wasted.

The transportation and handling of sterile packs may be problematic, in that there is usually some incidence of rupturing or bursting. This is due to the fact that an increase in pressure within the pack due to an increase in temperature or altitude will cause the pack to swell, thereby stressing the seal between the blister tray and the web covering the tray, which may in turn lead to the rupturing of the seal and leakage or contamination of the contents of the sterile pack.

SUMMARY OF THE INVENTION

According to the invention there is provided a burst-proof pack comprising a tray having at least one recess defined therein which houses a fluid, the recess being surrounded by a land, a web extending over and being sealed to the land by a sealing arrangement so as to provide a sealed compartment, the sealing arrangement including at least an inner and an outer peripheral sealing band defining therebetween an intermediate pressure dissipation channel for preserving the integrity of the sealed compartment in the event of one of the sealing bands being broached.

Preferably, the sealing bands are continuous and ring-shaped.

Conveniently, the web is a peelable web which is heat sealed over the tray, with a non-sealed portion of the web defining a manually grippable peeling tag.

In one form of the invention, the sealing arrangement comprises at least three sealing bands defining therebetween at least two intermediate pressure dissipation channels.

Typically, the sealing bands and intermediate channels are formed in a concentric array.

In an alternative form of the invention, the seating bands may be formed in a spiral array which is closed at both ends so as to define therebetween the intermediate pressure dissipation channel.

The at least one recess may comprise at least one swab recess and at least one swab nested within the recess, the swab being impregnated with a sanitizing fluid.

Typically, the park includes an array of five part spherical swab recesses, with each swab recess housing a single swab.

Advantageously, both the web and the land may be formed with contiguous peelable layers of low density polyethylene.

In one version of the invention, the at least one recess comprises first wet and second dry recesses defined within the tray, at least a liquid being accommodated in the first wet recess, and dry goods being accommodated in the second dry recess, with the web extending over both of the recesses so as to provide first and second respective separate wet and dry sealed compartments for the liquid and the dry goods.

Typically, the pack is a surgical pack, the liquid is a sanitizing liquid, and the wet compartment includes at least one swab impregnated with the sanitizing liquid.

Conveniently, the dry component includes dry wound-treating goods typically chosen from the group including dressing dispose bags, drapes, hand towels, disposable dressings and disposable gloves.

Advantageously, the land is uniplanar and comprises an outer peripheral land portion and a central dividing land portion forming part of a dividing wall between the first and second compartments.

Conveniently, the intermediate pressure channel defined by the at least two sealing bands extends around the outer peripheral land portion and a single sealing band extends between the first and second sealed compartments.

The tray is preferably a relatively rigid blister tray thermo-formed from a polystyrene or PVC rollstock having a thickness of 250 to 400 microns so as to lend a measure of crush-proof resistance to the tray.

The term "sanitizing fluid" may be understood as meaning any biocidal fluid, disinfectant or self-sterilizing fluid, and in one form of the invention comprises a saline solutions.

The sealing bands and the at least one intermediate channel defined by the sealing bands may be confirmed in a number of different ways, and may include various labyrinthine, concentric or spiral arrangements. The main feature of the invention is the fact that an at least one intermediate pressure dissipation channel is provided so as to act as a "first line of defense" in the event of one, and typically the inner seal band being broached.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein:

FIG. 4 shows a top plan view of a third embodiment of a partly opened pack of the invention;

FIG. 5 shows a side view of the pack of FIG. 4; and

FIG. 6 shows a cross-section on the line 6—6 of FIG. 4.

DESCRIPTION OF EMBODIMENTS

Figure 1:
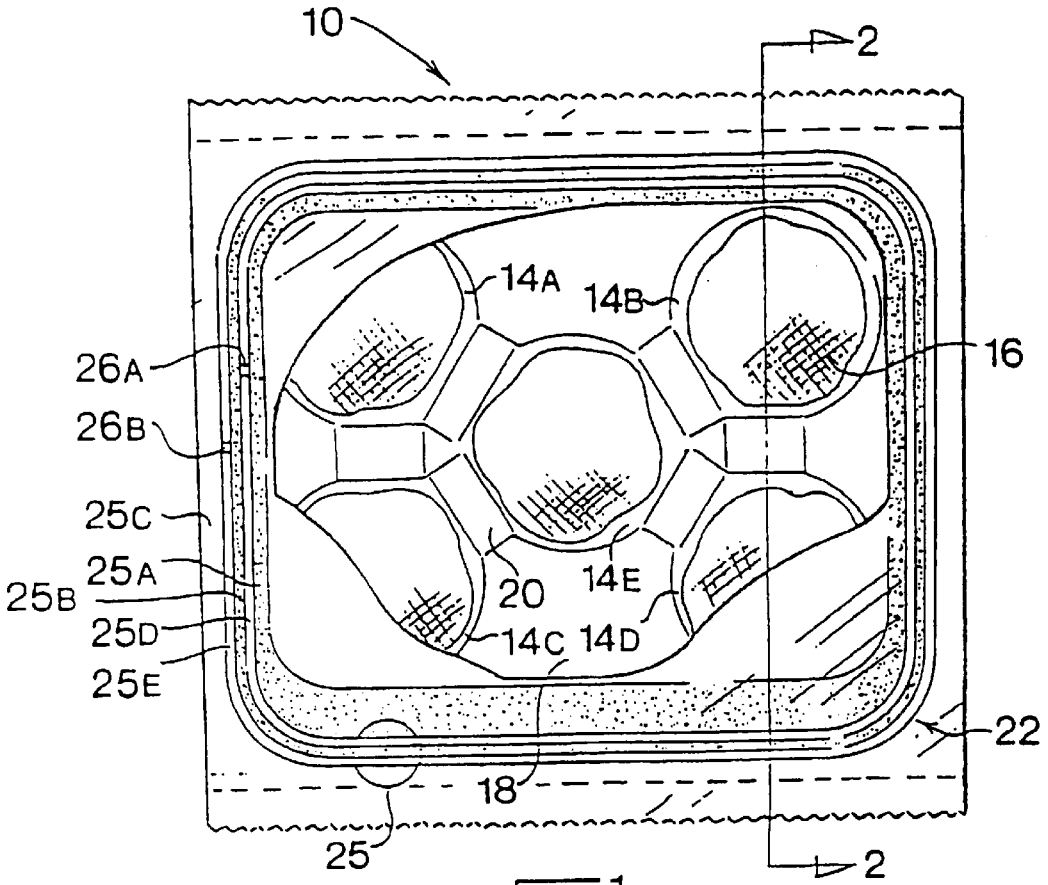
FIG. 1 shows a partly cut away top plan view of a first embodiment of a pack of the invention.
Figure 2:
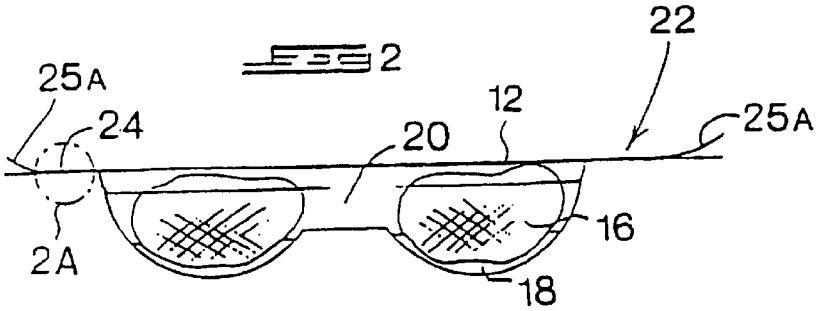
FIG. 2 shows a cross section on the line 2—2 of FIG. 1.
Figure 2A:
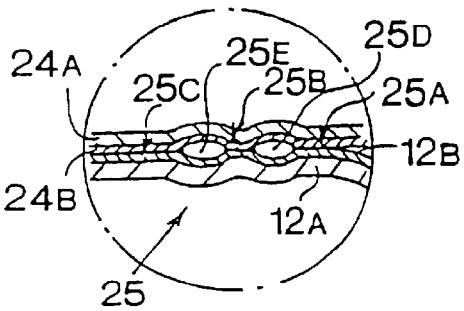
FIG. 2A shows a detail of a sealing arrangement forming part of the pack of FIG. 1.

Referring first to FIGS. 1, 2 and 2A, a first embodiment of a pack in the form of a swab pack 10 comprises a blister tray 12 which is vacuum formed from a clear polystyrene or PVC material having a thickness of 250 microns to 400 microns. The polystyrene or PVC layer 12A is laminated to an upper low density polyethylene (LDPE) layer 12B having a thickness of approximately 70 microns. The blister tray 12 is formed with five part-spherical swab recesses 14A to 14E within which surgical wound cleansing swabs 16 nest. Each of the surgical swabs 16 is formed from a gauze material using a swab making machine. As is clear from FIG. 2, the absorbent surgical swabs 16 are impregnated with a 0.9% disinfecting saline solution 18. A series of interleading channels 20 facilitates circulation of the non-absorbed saline solution.

The blister tray 12 is formed with an outer peripheral planar land 22 onto which a web 24 is heat sealed along a sealing arrangement 25. The sealing arrangement terminates short of the upper and lower edges of the planar land, thereby defining finger-grippable web flaps 25A which may be gripped to commence the peeling operation. The web is formed with an upper high density, polyethylene (HDPE) layer 24A having a thickness of approximately 40 microns and a lower LDPE layer 24B having a thickness of approximately 30 microns, with the sealing arrangement 25 between the contiguous LDPE layers of the blister tray 12 and the web 24 providing an hermetic seal, whilst at the same time allowing the web to be peeled away from the upper surface of the land 22.

As is clear from the detail in FIG. 2A, the sealing arrangement 25 comprises an inner peripheral heat sealed zone or band 25A, an intermediate continuous heat sealed band or zone 25B and an outer peripheral heat sealed band or zone 25C. An inner peripheral continuous dissipation channel 25D is defined between the sealing bands 25A and 25B, and an outer peripheral continuous dissipation channel 25E is defend between the sealing bands 25B and 25C. The concentric configuration of the bands is clear from FIG. 1. The pressure dissipation channels 25D and 25E serve to dissipate pressure and to increase the burst-proof nature of the pack. By way of explanation, in the event of a broach 26A occurring in the first sealing band 25A, this will cause the sealed compartment lo communicate with the inner dissipation channel 25D, which serves to dissipate the pressurized air and fluid once it has leaked through the broach, thereby acting as a "first line of defence". The dissipation channel 25D thus prevents the broach 26A from migrating through until it broaches the seal arrangement completely, as would be the case with a single broad seal. Similarly, should a further broach 26B subsequently be created between the inner and outer dissipation channels 25D and 25E, the channel 25F will effectively stop the broach 26B from spreading, and will act as a "second line of defence" for preventing the broach from extending through the third outermost sealing zone 25C. The sealing arrangement is created by using a heated die which is recessed along the dissipation zones or channels 25D and 25E, and which non-recessed portions serve to heat seal the zones 25A, 25B and 25C to one another. As the non-sealed zones 25D and 25E effectively reduce the overall area of the contact portion of the die, this results in an effective increase in downward pressure of the die as heat sealing takes place without having to increase the overall force applied to the die.

The entire packaging process takes place using a flat bed form-fill-seal machine, and the package is sterilised under gamma radiation until the swabs and saline solution have been packed and the package has been sealed.

The production steps of the swab pack may be briefly summarized as follows:

1. The semi-rigid blister tray is thermo-formed from PVC/polyethylene or polystyrene/polyethylene roll-stock having the aforementioned thickness of 250 to 400 microns so as to lend some stability and crush-proof resistance to the tray.
2. The tray is then conveyed along a load bed of the form-fill-seal machine so that the saline solution may be dosed into the central recess 14E, with the channels allowing the solution to flow evenly into the outer swab recesses 14A to 14D.
3. In the event of swabs being required, once subjected to gamma radiation, the swabs are placed within the recesses as the tray moves along the conveying drive.
4. The filled tray is then conveyed into a sealing section of the form-fill-seal machine for allowing the rollstock web of HDPE/peelable polyethylene or polyester/peelable polyethylene material to be heat sealed to the tray so as to provide a peelable lid.
5. Forward progression of the tray and web allows in-line cutting and trimming thereof for being presented at the out feed end of the machine as a completed product. The cyclical operation of the machine means that the forming, filling, sewing and cutting steps may be performed simultaneously in the case of high volume production.

Figure 3:
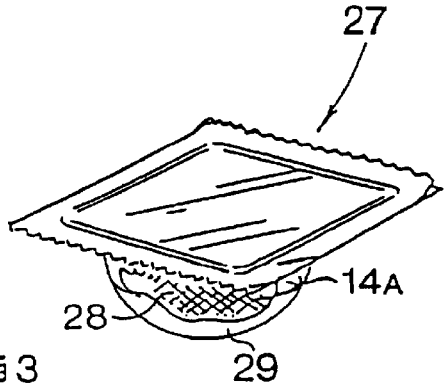
FIG. 3 shows a perspective view of a second embodiment of a pack of the invention.

Referring now to FIG. 3, a second alternative embodiment of a pack in the form of a unitary swab container 27 is shown for housing a single swab 28 within an appropriate swab recess 14A, which also contains a dosage of 0.9% saline solution 29. Naturally, the 0.9% saline solution may be replaced by any desired type of sanitizing fluid, including a disinfectant, a self-sterilising agent or a biocide.

A major advantage of the swab pack of FIGS. 1 to 3 is that it avoids the need for separate sterilized containers. As the swabs are impregnated with disinfecting fluid and are packed under sterile conditions, the aforementioned prior an steps of diluting and decanting are avoided.

Referring now to FIGS. 4 to 6, a surgical pack 30 comprises a blister tray 32 having wet and dry recesses 34 and 36 surmounted by a top peelable web 38 providing separate wet and dry sealed compartments 40 and 42. The tray is formed with an upper outer peripheral land 44 and a central dividing land 46 which is uniplanar with the outer land 44. The central dividing land 46 forms the top of a central curved dividing wall 48 dividing the wet and dry compartments 40 and 42. The peelable web 38 is affixed to the lands 44 and 46 by means of a sealing arrangement 50 comprising an outer peripheral seal 52, an inner peripheral seal 54 and a central dividing 56 extending between the inner peripheral seal 54 over the dividing land 46. The inner and outer peripheral seals 52 and 54 are separated by a uniform gap defining a pressure dissipation channel 58. In the particular embodiment, the outer and inner peripheral seals 52 and 54 are 2.25 mm wide, the channel 58 is 1.5 mm wide and the dividing seal 56 is 1.5 mm wide.

The wet compartment 40 is filled with five swabs 60 which are impregnated with a 0.9% saline solution. Part of the saline solution is shown at 62, where it has accumulated in a part spherical sump portion 64 formed at the base of the wet compartment 40. The sump portion 64 acts as a sump for any sanitizing fluid remaining in the wet cavity, as well as making the wet cavity the same depth as the dry cavity 42, thereby preventing the surgical pack from rocking to and fro when placed on a flat surface.

The dry compartment 42 includes dry goods in the form of a soiled dressing disposal bag 66, a drape 68, a hand towel 70, disposable dressings 72 and disposable gloves 74. The curved wall 48 which results in the kidney-shaped compartment 40 and the outward bulge 74 in the compartment 42 serves to rigidify the surgical pack and prevent it from flexing between the compartments.

The blister tray 32 is vacuum formed from a clear polystyrene or PVC material having a thickness from 250 to 400 microns, and having an upper laminated low density peelable polyethylene layer having a thickness of around 50 μm to 70 μm. The web is formed from upper and lower co-extruded high density polyethylene and low density polyethylene layers having a combined thickness of 60 μm to 90 μm. The LDPE layer typically has a thickness from 40 μm to 50 μm. Alternatively, the upper layer of the web may be formed from polyester to which a lower LDPE peelable layer is laminated. The lower density polyethylene interface allows the web to be peeled easily from the land of the tray, without significantly compromising the burst strength of the package. The intermediate dividing seal is a single seal for the reason that it is not as problematic if a broach occurs between the wet and dry compartments. In the event of the intermediate seal being broached, the increase in sealed volume provides the container with a greater pressure absorption capacity and serves to increase the integrity of the outer double seal. The overall peelability of the pack is also facilitated by the single intermediate seal.

The production steps of the swab pack are essentially similar to those described with reference to the embodiment of FIGS. 1 to 3, save that the aforementioned dry goods are deposited into the dry recess prior to the web being heat sealed to the land of the tray.

One advantage of the surgical pack of FIGS. 4 to 6 is that it provides, in a single package and with the requisite levels of sterilization, all of the wet and dry goods needed in an aseptic wound cleansing procedure.

The burst-proof feature of the pack of the invention results in very few, if any packs being rejected due to leakage or bursting. In addition, in the case of sterile packs, there is a far smaller likelihood of the sterility of the pack contents being compromised due to undetected leaks.

What is claimed is:

1. A burst-proof pack comprising a tray having at least one recess defined therein, a fluid housed within the tray, the recess being surrounded by a land, a web extending over and being sealed to the land by a sealing arrangement so as to provide a sealed compartment, the sealing arrangement including at least an inner and an outer peripheral sealing band defining therebetween an intermediate pressure dissipation channel for preserving the integrity of the sealed compartment in the event of one of the sealing bands being broached, wherein the at least one recess comprises first wet and second dry recesses defined within the tray, a liquid being accommodated in the first wet recess, and dry goods being accommodated in the second dry recess, with the web extending over both of the recesses so as to provide first and second respective separate wet and dry sealed compartments for the liquid and the dry goods, and wherein the pack is a surgical pack, the liquid is a sanitizing liquid, and the wet compartment includes at least one swab impregnated with the sanitizing liquid.

2. A pack according to claim 1 in which the sealing bands are continuous and ring-shaped.

3. A pack according to claim 1 in which the web is a peelable web which is heat sealed over the tray, with a non-sealed portion of the web defining a manually grippable peeling tag.

4. A pack according to claim 1 in which the sealing arrangement comprises three sealing bands defining therebetween at least two intermediate pressure dissipation channels.

5. A pack according to claim 1 in which the sealing bands and intermediate channels are formed in a concentric array.

6. A pack according to claim 1 in which the sealing bands are formed in a spiral array which is closed at both ends so as to define therebetween the intermediate pressure dissipation channel.

7. A pack according to claim 1 in which the at least one recess comprises at least one swab recess and at least one swab nested within the recess, the swab being impregnated with a sanitizing fluid.

8. A pack according to claim 7 which includes an array of five part spherical swab recesses, with each swab recess housing a single swab.

9. A pack according to claim 3 in which both the web and the land are formed with continuous peelable layers of low density polyethylene.

10. A pack according to claim 1 in which the dry compartment includes a dry wound-treating goods chosen from the group consisting of dressing disposal bags, drapes, hand towels disposable dressings and disposable gloves.

11. A pack according to claim 1 in which the land is uniplanar and comprises an outer peripheral land portion and a central dividing land portion moving part of a dividing wall between the first and second sealed compartments.

12. A pack according to claim 11 wherein the intermediate pressure channel defined by the at least two sealing bands extends around the outer peripheral land portion and a single sealing band extends between the first and second sealed compartments.

13. A pack according to claim 2, in which the web is a peelable web which is heat sealed over a tray, with a non-sealed portion of the web defining a manually grippable peeling tag.

14. A pack according to claim 2 in which the sealing arrangement comprises three sealing bands defining therebetween at least two intermediate pressure dissipation channels.

15. A pack according to claim 3 in which the sealing arrangement comprises three sealing bands defining therebetween at least two intermediate pressure dissipation channels.

16. A pack according to claim 2 in which the sealing bands and intermediate channels are formed in a concentric array.

17. A pack according to claim 3 in which the sealing bands and intermediate channels are formed in a concentric array.

18. A pack according to claim 4 in which the sealing bands and intermediate channels are formed in a concentric array.

* * * * *